United States Patent [19]

Gyenge et al.

[11] Patent Number: 4,674,647

[45] Date of Patent: Jun. 23, 1987

[54] COLLAPSIBLE STORAGE BIN

[75] Inventors: Andrew Gyenge, Prince George, Australia; Michael D. Johnson, Tacoma; John A. Malmanger, Vashon Island, both of Wash.

[73] Assignee: Xytec Plastics, Inc., Tacoma, Wash.

[21] Appl. No.: 802,628

[22] Filed: Nov. 29, 1985

Related U.S. Application Data

[63] Continuation of Ser. No. 747,810, Jun. 21, 1985, abandoned.

[51] Int. Cl.[4] ..... B65D 7/24

[52] U.S. Cl. ..... 220/6; 220/1.5

[58] Field of Search ..... 220/6, 1.5, 66

[56] References Cited

U.S. PATENT DOCUMENTS

| | | | |
|---|---|---|---|
| 2,666,552 | 1/1954 | Coit, Jr. | 220/6 X |
| 2,756,894 | 7/1956 | Phillips | 220/6 |
| 3,040,925 | 6/1962 | Mills | 220/1.5 |
| 3,349,939 | 10/1967 | Averill | 220/6 |
| 3,628,683 | 12/1971 | Friedrich | 220/6 |
| 3,765,556 | 10/1973 | Baer | 220/1.5 |
| 3,870,185 | 3/1975 | Sanders et al. | 220/1.5 X |
| 3,874,546 | 4/1975 | Sanders et al. | 220/6 |
| 3,955,703 | 5/1976 | Zebarth | 220/6 |
| 3,964,636 | 6/1976 | Rehrig | 220/306 |
| 3,985,258 | 10/1976 | Quigley et al. | 220/4 F |
| 3,998,327 | 12/1976 | Box | 206/508 |
| 3,999,676 | 1/1976 | Trebilcock et al. | 220/6 |
| 4,000,827 | 1/1977 | Emery | 220/4 F |
| 4,005,795 | 2/1977 | Mikkelsen | 220/6 X |
| 4,020,967 | 5/1977 | Hammond et al. | 220/6 |
| 4,044,910 | 8/1977 | Box | 220/6 X |
| 4,081,099 | 3/1978 | Shead | 220/6 |
| 4,099,640 | 7/1978 | Nessfield et al. | 220/6 |
| 4,162,737 | 7/1979 | Clive-Smith | 220/1.5 |
| 4,170,313 | 10/1979 | Caves et al. | 220/6 X |
| 4,186,841 | 2/1980 | Buckley et al. | 220/6 |
| 4,214,669 | 7/1980 | McQuiston | 220/6 |
| 4,240,555 | 12/1980 | Jurasek | 206/511 |
| 4,320,845 | 3/1982 | Waller | 220/6 |
| 4,506,798 | 3/1985 | Goutelle | 220/1.5 |

*Primary Examiner*—Steven M. Pollard

*Attorney, Agent, or Firm*—Kolisch, Hartwell & Dickinson

[57] ABSTRACT

The present invention provides a heavy duty, high strength, collapsible pallet type container which may be formed entirely by injection molded plastic techniques and which is designed for nesting when stacked in the erected or collapsed mode. The side and end walls of the container are pivotally connected to the pallet base means of integrally molded snap-fitting hinges.

15 Claims, 13 Drawing Figures

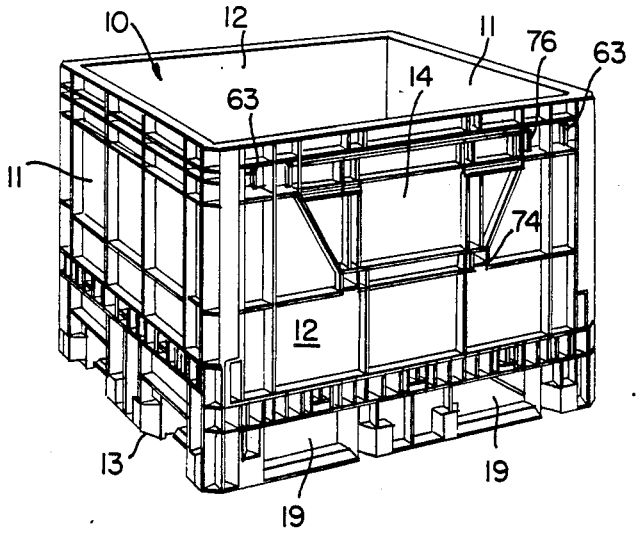
FIG. 1
FIG. 2
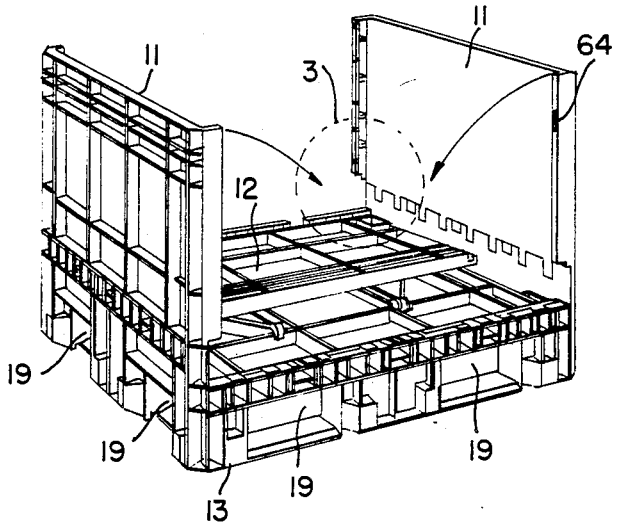
FIG. 3
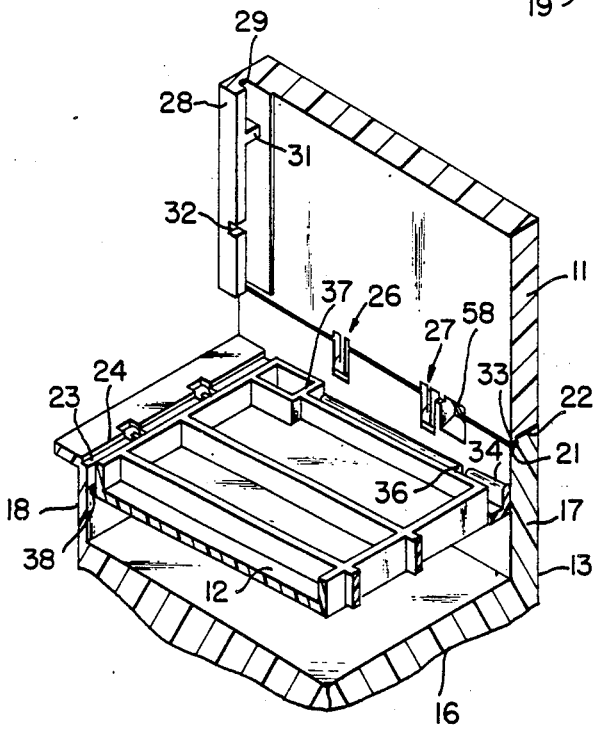

FIG. 6
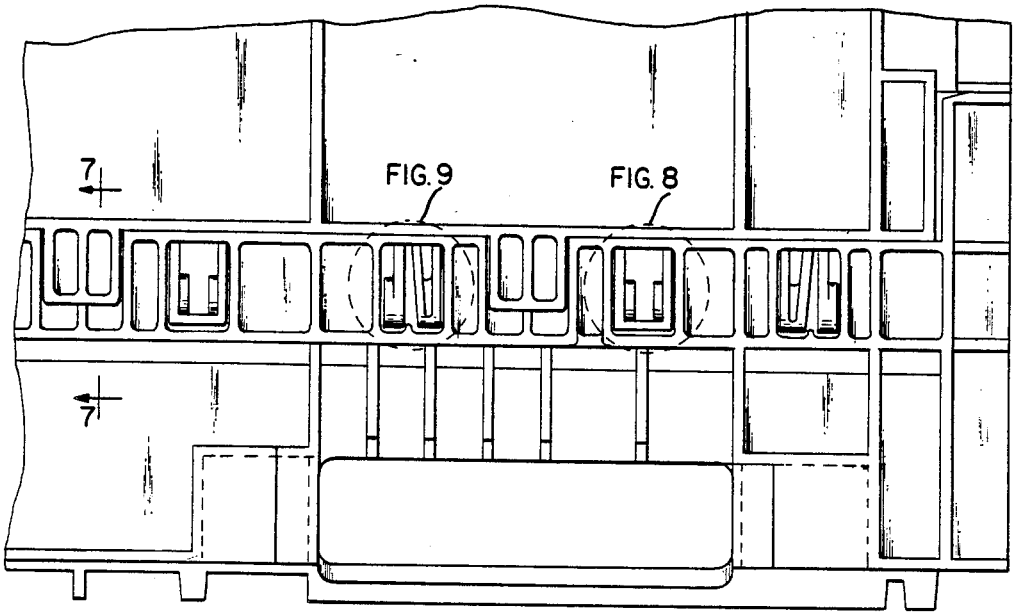
FIG. 7
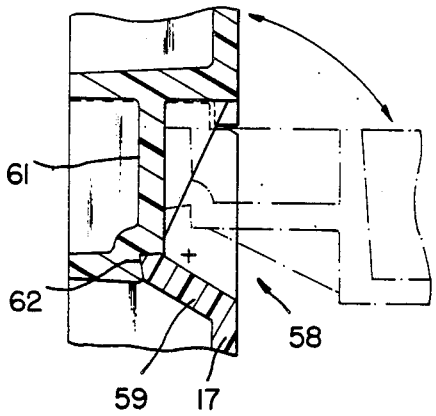
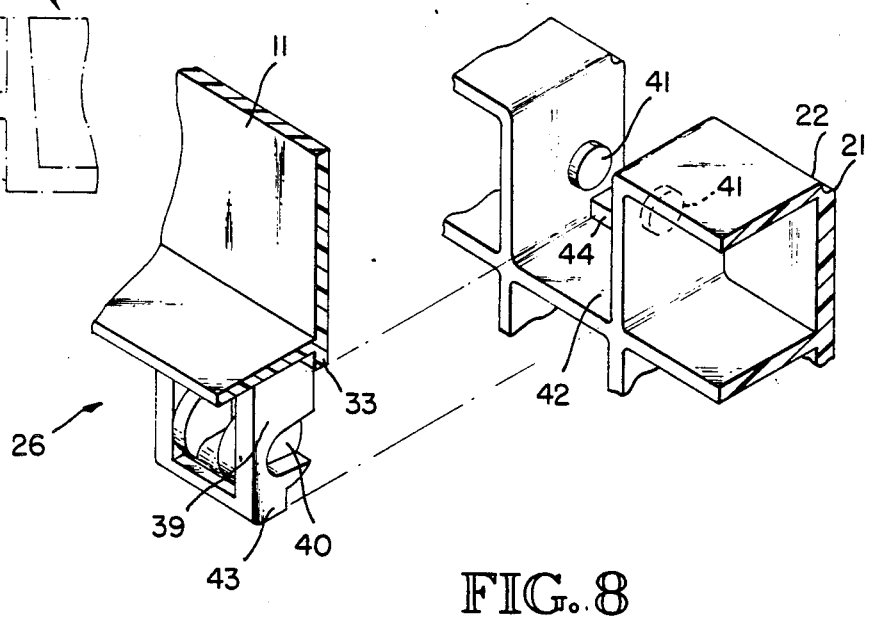
FIG. 8

FIG. 9
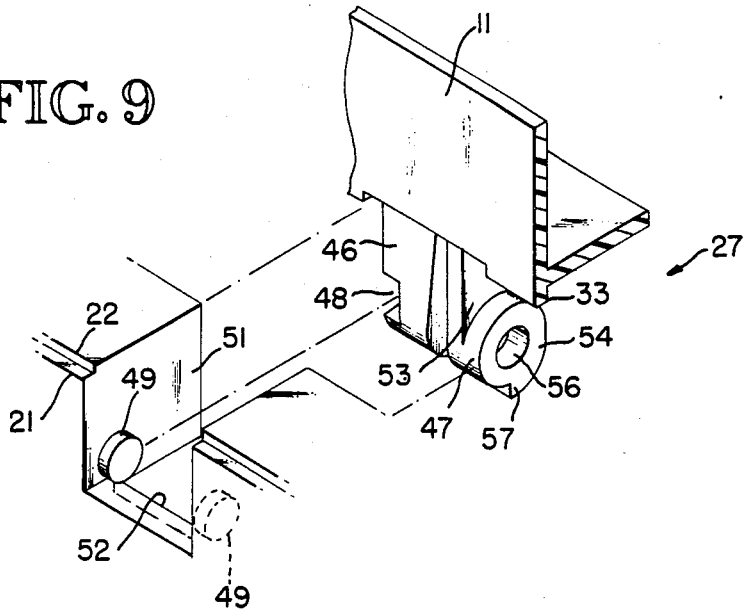
FIG. 10A
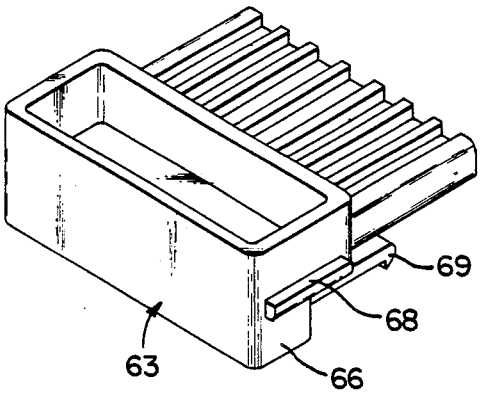
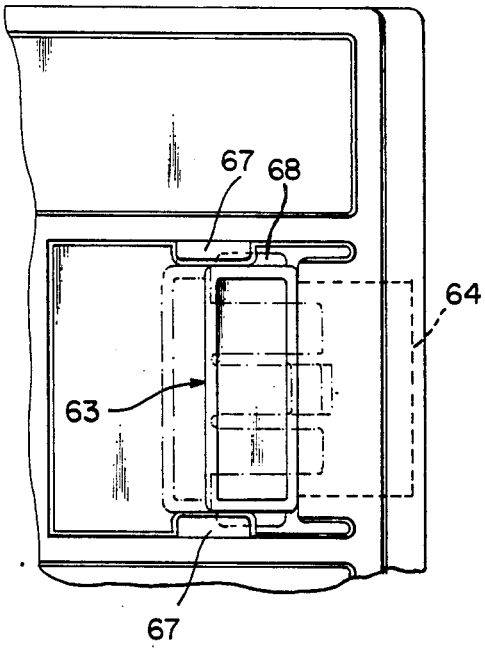
FIG. 10

COLLAPSIBLE STORAGE BIN

This application is a continuation of application Ser. No. 747,810, filed June 21, 1985, now abandoned.

BACKGROUND OF THE INVENTION

1. Field of the Invention

The present invention relates to collapsible containers having pallet-type bases with upright container walls pivoted to the base and adapted to be moved to a folded position on the pallet for return transport in the empty condition. This type of container is designed for fork lift handling and is adaptable for a wide variety of general utility purposes ranging from the transport or storage of packaged goods to bulk commodities such as produce and the like.

2. The prior Art

Collapsible containers having foldable side walls for return shipping are well known in the prior art and are subject to a wide range of uses. Such containers range in size from rather large capacity cargo container units for rail and shipboard handling to rather small light-weight containers designed for such commodities as bakery goods and farm produce. Examples of the latter type of collapsible containers made from molded flexible plastic with integral hinge structures and snap fitting joints are contained in the Saunders et al U.S. Pat. Nos. 3,870,185 and 3,874,546 and the Waller U.S. Pat. No. 4,320,845. These containers may be characterized as being rather light weight small capacity structures and are designed for carrying light weight fragile or frangible articles such as loaves of bread or egg cartons.

Larger bin structures for general utility use, of the type capable of being handled by a fork lift, have also been constructed from molded rigid plastic materials. This type of container may be characterized as a pallet base container. The Kardell U.S. Pat. No. 4,057,165 is one such device wherein flexible plastic hinge members permit the side walls to be folded onto the pallet base. The Vande Drink U.S. Pat. No. 4,235,345 and the Te-Chi Hsu U.S. Pat. No. 4,300,695 are further examples of injection molded collapsible containers usable for general utility purposes. The Te-Chi Hsu patent is exemplary of injection molded plastic structures utilizing metal hinge pins to accomplish the hinging function between plastic panels. The metal hinge pins are designed to withstand lateral loads and are intended to provide the necessary strength to the structure.

Generally speaking, the problem encountered with prior art efforts to design molded plastic containers for heavy duty purposes has been the difficulty in providing a pallet type base with foldable walls which, when erected, are strong enough to carry extremely heavy loads such as machine parts or heavy metal objects for instance. Although it is well known in the art that hinge members may be molded integrally with the side and bottom walls and simply snapped together to form collapsible containers, the resulting structure will not stand up under heavy use. On the other hand, if such devices as metal clips, metal hinge pins or other reinforcing members are added to the collapsible multi-paneled plastic structure the parts usually become separated and lost when the container is collapsed for return shipment. In addition, such designs involving multiple separate parts of diverse materials are extremely expensive to manufacture and usually too cumbersome to be practical. Other considerations such as replacement of worn out parts and the ability to keep the container structure clean have plagued the industry for years.

SUMMARY OF THE INVENTION

The present invention provides a heavy duty, high strength, collapsible pallet type container which be formed entirely by injection molded plastic techniques and which is designed for nesting when stacked either in the erected or collapsed mode. The side and end walls of the container are pivotally connected to the pallet base by means of integrally molded snap-fitting hinges. There are no special clips or other metal parts and hence no lose or separate parts used in conjunction with the container at all. The special structural configuration of the mating side and end walls and the pallet base insure that no lateral loads are placed on the molded hinge structures, hence extremely high-level loading interior of the container is possible. The novel configuration of side wall and end wall interlocking results in enhancing the engagement between the end and side walls with increased loading within the container. Longitudinal movement in the vertical direction between the end and side walls or side wall shifting is also prevented by the novel connection and interaction between the end and side wall edges. Likewise, special provision is made for absorbing lateral shock forces directed against the outside surface of the erected side walls, thereby protecting the molded hinge elements connecting the end and side walls to the pallet base. The rigidity of the connection or engagement between the end and side walls is extremely important during lifting of a filled container by such means as a fork lift. There is a normal tendency to skew the ends and side walls during lifting, resulting in hinge damage. This skewing is prevented by means of the novel structure which interconnects end and side wall edges.

Provision is also made for a slightly domed or upwardly convexed pallet surface which forms the bottom wall of the container. Loads received by the convex bottom wall are transferred into the side and end walls in such a manner as to still further enhance their engagement. Two folding patterns for collapsing the side and end walls onto the pallet base are disclosed, and in all instances nesting type stacking is possible without endangering the hinged joints between the side and end walls and the bottom wall by the added weight of stacking. Additionally, the container is so designed as to receive a lid structure of appropriate configuration with none of the lateral forces of the loaded side and end walls being transferred to the lid. Because of the novel configuration of the integrally molded hinge elements and the interfacing between the side walls and end walls with the base walls of the pallet, it is possible to construct a container with extremely smooth interior surfaces. This feature is of importance with the handling of agricultural produce and the like and may be important in those instances where cleaning of the interior of the container is desirable or necessary. All of these advantages are obtained with the present invention while keeping the manufacturing costs of the container at a competitive level. Advantages are also obtained in return shipping, wherein the container is reduced in size in the range of 2.8 to 1, to 3 to 1. This return ratio is considered to be of extreme importance taking into consideration present day shipping rates.

BRIEF DESCRIPTION OF THE DRAWINGS

Reference is made to the accompanying drawings illustrating preferred embodiments of the invention wherein;

FIG. 1 is a perspective view of a first embodiment of the collapsible container of the present invention in its fully assembled or erected condition;

FIG. 2 is a perspective view of the embodiment of FIG. 1 illustrating the order of folding the side and end walls to obtain the collapsed configuration of the container for return shipment;

FIG. 3 is a partially sectioned isometric detail of the area indicated by the broken line circle in FIG. 2;

FIG. 6 is a partial elevation of the outside wall of the container in its erected condition showing the placement of snap hinge elements acting between the side and end walls of the container and the pallet base wall;

FIG. 7 is a cross-sectional view along lines 7—7 of FIG. 6 illustrating a hinge protector structure for absorbing inwardly directed shock loads against the erected side walls of the container;

FIG. 8 is an exploded partially sectioned detail of one form of snap hinge indicated by the dotted line circle 8 in FIG. 6;

FIG. 9 is an exploded partially sectioned detail of a second form of snap hinge indicated by the dotted line circle 9 in FIG. 6;

FIG. 10 is an elevational detail illustrating a wall latch structure acting between the end and side walls to prevent inward folding of the erected walls prior to filling of the bin;

FIG. 10A is a perspective view of the sliding latch element shown in FIG. 10;

DESCRIPTION OF THE PREFERRED EMBODIMENTS

Figure 4:
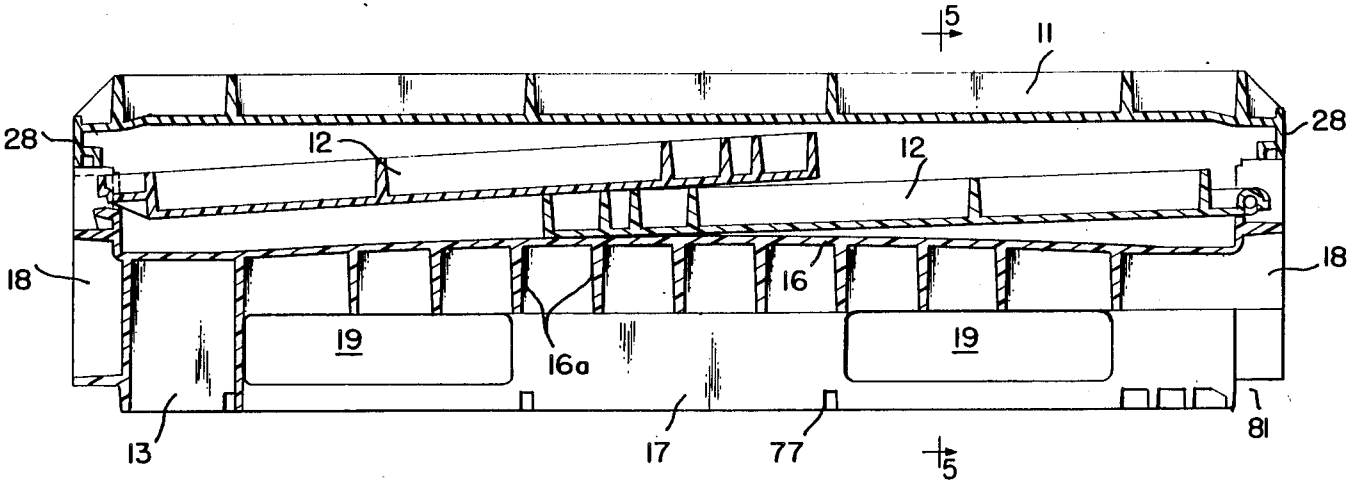
FIG. 4 is a transverse sectional view showing the folded position of the end and side walls of the pallet container.

FIG. 1 illustrates a collapsible container 10 according to the present invention which includes the side walls or wall members 11, opposed end walls or wall members 12 and a pallet base or bottom wall structure 13. The entire structure of the container is most advantageously formed from a material such as high density polyethylene utilizing well known injection molding processes. The thickness of the side wall, end wall and bottom wall structures may vary and will be determined by the strength and durability requirements for any particular bin or container. It will also be noted that any configuration of ribbing or reinforcing may be provided for the wall members as is well known in prior art. Preferably, however, the inside surfaces of the side walls 11, end walls 12, and the bottom pallet wall 13 are smooth and free of obstructions so as to be easily cleaned. One of the end walls 12, as shown in FIG. 1, may also be provided with a hinged door or gate 14 to facilitate unloading of the container under certain conditions if desired.

Figure 5:
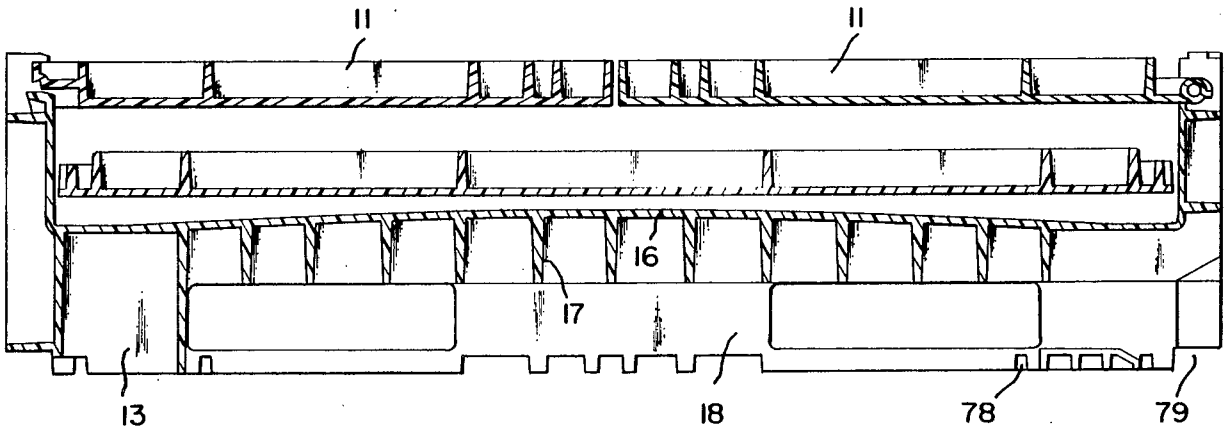
FIG. 5 is a transverse cross-section taken above lines 5—5 of FIG. 4.

Referring to FIGS. 3-5, the pallet base 13 includes the bottom wall 16 molded with appropriate strengthening webs **16*a* integral therewith. The bottom wall 16 is formed in an upwardly convexed curve as seen most clearly in FIGS. 4 and 5 and extends into the base side and base end walls (also referred to as subwalls) 17 and 18, respectively, to which the side wall and end walls 11 and 12 respectively are pivotally attached. As shown most clearly in FIG. 3, the base side walls 17 extend to a higher elevation then the base end walls 18 to permit folding as will presently be described in detail. As is customary, the pallet base 13 is formed with a support wall around the bottom periphery thereof and includes the spaced apart openings 19**, two per side, which adapt the pallet for lifting by the tines of a fork lift. With this arragement, the pallet may be picked up from any side by a fork lift for transport.

Each of the base side wall members 17 is provided with a groove 21 extending the length of the inner edge of the wall which provides a shoulder 22. The shoulder acts as a load bearing surface in cooperation with a lip formed on the associated side wall as will presently be described. Likewise each base end wall 18 includes a groove 23 which provides a shoulder 24 for cooperation with a lip on the associated end wall for the same purpose.

The side walls 11 are pivoted to the base side walls 17 along the common pivotal axis of the multiple sets of hinge structures 26 and 27. The details of these hinge structures will be described in detail later with relation to FIGS. 8 and 9 of the drawings. It will be understood that multiple sets of these hinge structures 26 and 27 are used along the lower edges of both the side walls 11 and the end walls 12. These sets of hinge structures are identical in detail and the number and placement of the hinges will depend on the design of the particular container. Each side wall 11 is provided with identically formed vertically extended flange members 28 formed on the edge of its inner surface. As illustrated in FIGS. 2 and 3, each flange 28 on the opposite ends of each of the side walls has a groove 29 of some depth with connecting webs 31 vertically spaced along its length. The inner face of the flange 28 is provided with a plurality of notches 32 also vertically spaced along its length. The webs 31 and notches 32 are designed to cooperate with the mating webs and notches in the end walls when the walls are in the erected position as will presently be described. The bottom inner edge of each side wall 11 comprises a lip member 33 running the length of the wall. The lip 33 is designed to cooperate and interfit with the groove 21 and shoulder 22 of the adjacent base side wall to provide a bearing surface for absorbing the forces acting against the inner surface of the walls when the container is loaded. As seen most clearly in FIG. 3, the lip 33 engages the groove 22 in the base side wall and the bottom surface of the side wall 11 rests vertically on the top edge of the wall 17 when the side wall is erected.

The end walls 12 may be identical in detail and are connected to the base end walls 18 by means of hinge members which are identical to those used for the side walls 11. Also a lip 38 is formed on the bottom edge of each wall 12 and cooperates with the groove 23 and shoulder 24 in the manner described with relation to the lip 33 of the side walls 11. As seen in FIG. 3, the vertical side edge of each end wall includes a vertically extending flange 34 which is designed to engage the groove 29 in the adjacent side wall flange when both end and side walls are erected with movement of the edge margin or ridge of the flange into groove 29. The flange 34 is provided with a plurality of spaced notches 36 which are vertically spaced so to receive the webs 31 in the side wall flanges 28. Likewise, the flange 34 is provided with a plurality of spaced webs, such as the web 37, which engage the notches 32 in the side wall flange 28. This structural arrangement prevents the end walls from pivoting or being forced passed the vertical when they are raised against the flanges 28 of the erected side walls. Any force applied to the inside wall surfaces will, of course, enhance the engagement between the wall edges. The engagement between the respective notches and webs on the flanges of the end and side walls serves to lock the two walls together against any relative vertical shifting. This shifting or skewing of the side and end walls normally tends to occur during lifting of the loaded container with a fork lift and may result in severe hinge damage.

Referring now to FIGS. 6 through 9, the hinge structures will be described in detail. The hinge member 26 as well as the hinge 27 are molded integrally with the side and end wall panels obviating the need for any special hardware or removable parts. The hinge structure 26 shown in detail in FIG. 8 includes a rectangular hinge body 39 extending from the bottom edge of the associated side wall with the inner face thereof being flush with the inside surface of the associated wall. Although the detailed configuration of the hinge body may very somewhat, each of the side walls of the hinge body is provided with an elongated slot 40 which engages a boss or cylindrical protrusion 41 formed on the side walls of a U-shaped opening 42 in the associated base side or end wall. It will be noted that slots 40 are open ended on the inward side thereof to permit insertion into the U-shaped opening into engagement with the bosses 41 in a lateral direction. The hinge body 39 preferably closely conforms to the configuration of the opening 42 so as to substantially close the opening when the side wall is in place. The body 39 also includes a downwardly extending protrusion 43 which engages a shoulder 44 in the bottom of the U-shaped opening 42. The hinge member 26 thus provides a pivot or hinge point about the axis of the bosses 41 when the side wall is folded inwardly. The protrusion 43 and the shoulder 44 prevent the side wall from being pivoted outwardly beyond the vertical and also provide protection for the hinge in the event of any lateral impact on the outside wall of the container.

FIG. 9 illustrates the second type of hinge 27 utilized in conjunction with the hinge member 26. The hinge member 27 is substantially more complex in its structure and is characterized as a "snap hinge", having the added function of retaining the end and side walls against removal from the pallet base. As shown in FIG. 9, the hinge structure 27 is also molded integrally with the side or end wall structure with its inside surface flush with the inside face of the wall. The hinge has a two part body comprising the body members 46 and 47. The body member 46 is similar to one side of the body 39 of the hinge member 26 in that it contains an open ended slot 48 which is designed to receive one of the hinge bosses 49 located in the U-shaped opening 51 in the adjacent base wall. The pivotal axis provided by the bosses 49, of course, coincides with the axis of the bosses 41 of the adjacent hinge structure 26. The hinge body 46 functions in the manner described for the hinge body 39 to provide a hinge point and also includes a protrusion (not shown) for engagement with a shoulder 52 in the opening 51 of the adjacent base wall. This engagement prevents the side wall or end wall from being pivoted beyond the vertical position and also provides impact protection for the associated hinge boss 49. The other body portion 47 has a relatively thin walled shank 53 terminating in a cylindrical hub 54 which is provided with a bore 56 for receiving one of the bosses 49. The body portion 47 also includes a protrusion 57 for cooperating with the shoulder 52 to limit the pivotal movement of the container wall to the vertical position. Since the shank 53 of the hinge body is somewhat flexible, it may be deformed to such an extent as to allow the boss 49 to engage the bore 56 of the hinge member and to snap the remaining part of the hinge into engagement with the oppositely facing boss 49. With the snap hinge 27 in engagement with the bosses 49, the associated container wall is held in removable attachment with the pallet base.

To further protect the pivotally attached side walls from shock loads directed laterally against the outside surfaces thereof, each hinge set 26-27 may be provided with an adjacent wall protector structure 58 shown in detail in FIGS. 3 and 7. The purpose of the wall protector 58 is, of course, to prevent any such lateral shock loads from damaging the hinge members 26 and 27. Referring to FIG. 7, the base side or end wall has a recess formed therein which provides an upwardly and outwardly directed stop or abutment 59 which engages an integrally formed stop 61 on the associated side or end wall. The stop portion 61 is formed with a groove or slot 62 which receives and acts against the terminal end of the abutment 59 on the base wall. Thus, the protrusions 43 and 57 on the hinge members 26 and 27 respectively and the abutment 59 and stop member 61, prevent any lateral shock loads, directed against the outside surfaces of the walls, from being applied to the hinge structures. The protective lips 33 and 38 on the side and end walls 11 and 12 respectively cooperate with the associated shoulders on the base side and end walls to absorb lateral loading on the inside surface of the walls to protect the hinges. The engagement between the interlocking flanges on the mating edges of the ends and side walls serve to absorb the remaining lateral loads applied to the inner faces of the walls as the container is filled thus preventing any loading whatsoever on the hinge members.

In order to hold the end walls in their erected position as shown in FIG. 1 prior to filling the container, each end wall may be provided with slide latch structures 63 mounted on each side edge adjacent the upper ends thereof for engagement with the flanges 28 of the side walls 11. The slide latches may be received in suitable openings 64 in the flanges 28 to hold the end walls from collapsing inwardly until the container is filled. FIGS. 10 and 10A illustrate the details of a slide latch structure which may be used for this purpose. As seen in FIGS. 10 and 10A, the slider 66 is held in position against the end wall by means of the guides 67 which engage the tabs 68 on the slider and allow the slider to be moved into engagement with the slot 64 in the side wall flange 28. The slider 66 is held against removal in the unlatched position by means of the latch fingers 69 which engage appropriate depressions in the end wall surface.

As aforementioned, one or both of the end walls 12 may be provided with a suitable door 14 which is connected to the end wall by means of snap hinge connectors 74 which may be identical to the snap hinge 27 shown in FIG. 9. It will be understood, of course, that the bottom edge of the hinged door will also be provided with a lip (not shown) for engagement with an appropriate shoulder on the wall 12 to absorb any lateral loads on the door so as to protect the hinge members in a manner previously described. Also the door 14 may be latched to the end wall structure by means of slide latches 76 mounted on the end walls. These latches may be substantially identical in the structure and operation to the slide latch shown in FIGS. 10 and 10A.

Although no top structure is illustrated, it will be obvious to those skilled in the art that a top structure may be provided for the container with the proper configuration for engaging the top edges of the erected ends and side walls. Since the lateral loads on the ends and side walls are absorbed by their novel interconnections, there will be no loads applied to the cover structure.

FIGS. 2, 4 and 5 illustrate the manner in which the side and end walls are folded in order to obtain the stackable collapsed container. Referring to FIG. 2, and assuming an empty container, the slide latches 63 are first moved to the retracted position releasing the end walls 12 from the side walls 11. The end walls are then folded inwardly to rest on the base structure or bottom wall 16 of the pallet as illustrated in FIG. 4. Since the end walls 12 have a height which is greater then half the distance across the bottom wall 16, the walls will overlap as shown in FIG. 4. The order in which the end walls are folded is, of course, irrelevant because they are both pivoted at the same height. The next step is to fold each of the side walls 11 inwardly with the inwardly facing surfaces of the flanges 28 on each end of each side wall coming to rest on the upper edges of the base end walls 18. With this configuration, no weight or stress is applied to the overlapped previously folded end walls 12. Also, since the base side walls 17 are higher in elevation, the vertical height of the side walls 11 may be designed to be one half of the length of the bottom wall 16 and pallet base as shown in FIG. 5. There is therefore no overlapping of the side walls which form a stable platform on which to stack another collapsed or fully erected container. Referring to FIGS. 4 and 5, it is to be noted that the base end and side walls 17 and 18 are provided with a plurality of notches or openings 77 and 78 respectfully which are aligned with the reinforcing webs of the outside surfaces of the side walls 11 to permit nesting. Additionally, the peripheral edges of the end and side base walls are inset as at 79 and 81 so as to permit the pallet base to be nested onto the folded side walls of another container. The recessing 79 and 81 also permits a folded or erected container to be nested on top of another erected container.

Figure 11:
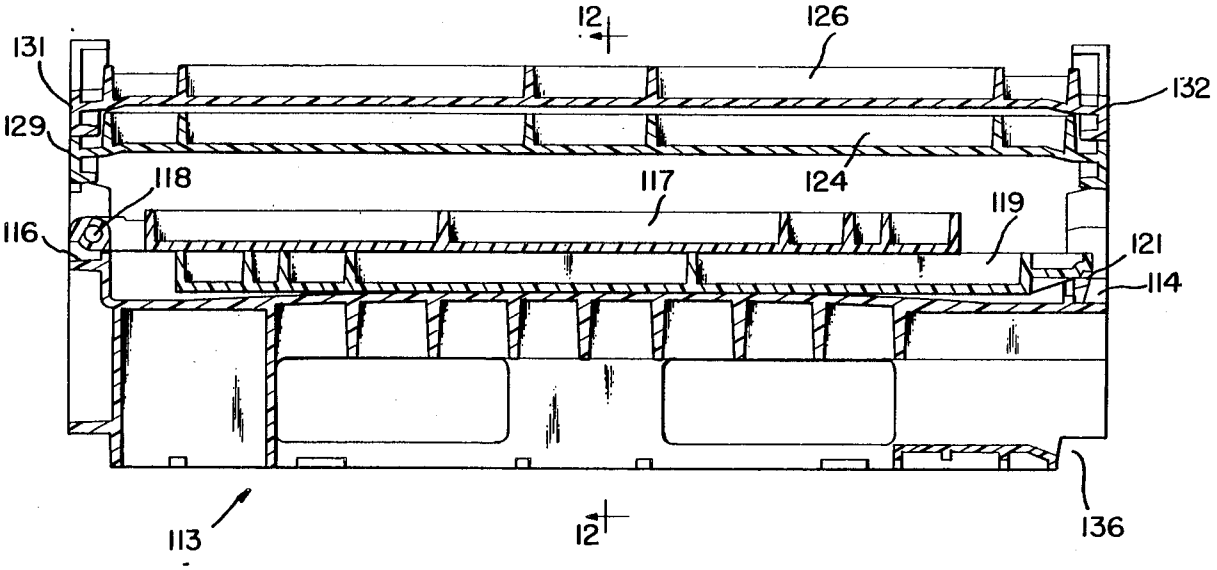
FIG. 11 is a center line sectional view showing the folded position of the end and side walls of a second embodiment of the collapsible bin.
Figure 12:
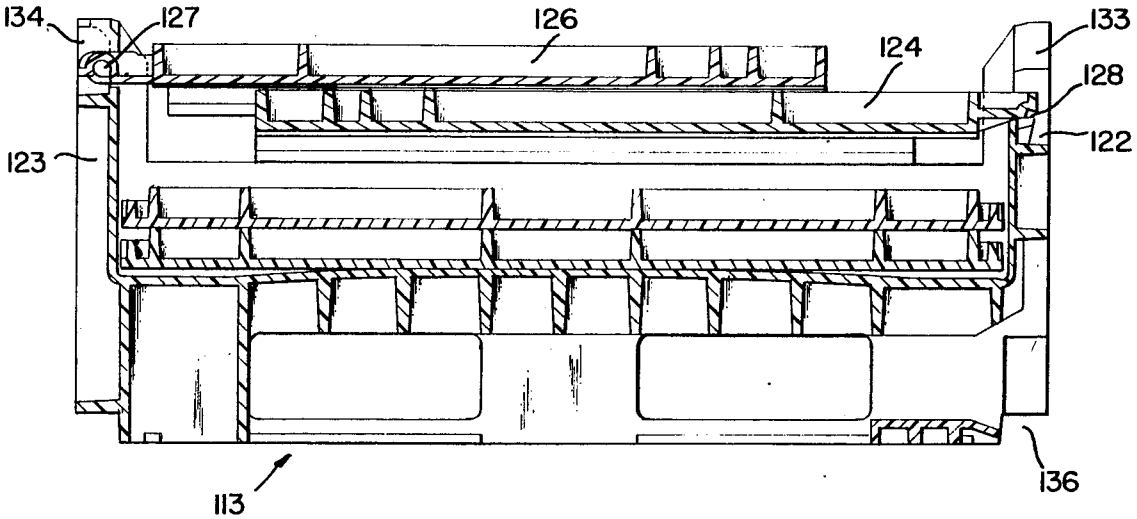
FIG. 12 is a cross-sectional view taken along lines 12—12 of FIG. 11 showing the position of the folded end and side walls.

FIGS. 11 and 12 illustrate a second embodiment of the invention wherein the side and end walls are hinged to the respective base walls at four different elevations providing for a container of smaller dimensions while preserving the ability to stack the collapsed container with other collapsed or erected containers. It will be understood that the hinge structures and hinge protective features of the FIGS. 1–10 embodiment will be utilized in the construction of the container of FIGS. 11 and 12, the only difference being the manner in which the side and end walls are folded inwardly to collapse the container. As seen in FIGS. 11 and 12, the pallet base 113 is provided with a first base end wall 114 and a second base end wall 116. The end wall 117 is pivoted to the base wall 116 at the pivot point 118 and the end wall 119 is pivoted to the base wall 114 at the pivot axis 121. The pivot point 118 is located the approximate thickness of the end walls and webbing above the pivot point 121. With this arrangement, the end wall 119 may be moved to the position shown in FIG. 11 lying substantially flat on top of the bottom wall of the pallet. The end wall 117 is then pivoted inwardly so as to rest on top of the end wall 119.

Referring to FIG. 12, the base side walls 122 and 123 provide pivotal attachments for the side walls 124 and 126 respectively. The pivotal attachment 127 for the side wall 126 is located the thickness of a side wall and webbing above the pivot point 128 for the side wall 124, permitting the wall 126 to lie flat on top of the side wall 124 and to be supported thereby. As shown in FIG. 11, one flange 129 of the side wall 124 engages the top surface of the base end wall 116 for support along its length and the flanges 131 and 132 of the side wall 126 rest on the outside surface of the side wall 124. In order to stack successive erected or collapsed containers on a collapsed container, the base side walls 122 and 123 have corner posts 133 and 134 respectively formed by the side wall ends so as to support the stacked containers without applying any pressure to the folded side walls 124 and 126. For this purpose, the peripheral edge of the pallet base is recessed as at 136 so as to nest between the corner posts 133 and 134.

Although the present invention has been described and illustrated with respect to two specific embodiments thereof, it will be apparent to those skilled in the art that modifications to the structures described may be made without departing from the spirit of the invention or from the scope of the appended claims.

What is claimed is:

1. A collapsible container comprising;

base means providing a container bottom wall, said base means including opposite facing base end and base side walls extending upwardly from said bottom wall, a pair of opposing side wall members pivotally attached to respective ones of said base side walls, a pair of opposing end wall members pivotally attached to respective ones of said base end walls, each of said side wall members including side edge flanges extending inwardly from the inner face thereof along a substantial length thereof, each of said end wall members including end edge flanges extending away from the inner face thereof along a substantial length thereof, said side and end edge flanges including mating groove and ridge portions to prevent the end and side wall members from pivoting beyond the vertical in an outward direction when engaged, whereby loading on the interior of said wall members serves to enhance the engagement between said flanges; and means acting between said side and end edge flanges for preventing longitudinal movement therebetween when engaged.

2. The container of claim 1 including latch means acting between said side and end edge flanges to prevent inward collapsing of said wall members prior to filling.

3. The container of claim 1 wherein said bottom wall comprises an upwardly curved convex surface means for receiving vertical loads within said container, said convex surface means serving to transfer vertical loads thereon laterally into said base end and base side walls.

4. The container of claims 1 or 3 wherein;

said base means includes vertical peripheral support walls extending downwardly from said bottom wall, said support walls locating said bottom wall above the container support surface and providing multiple access openings for lifting said container by engagement with the base means, and said support walls, said bottom wall and said base end and base side walls being formed of integral molded plastic material.

5. The container of claim 1 or 3 wherein;

said end and side wall members have bottom edge portions disposed for rectilinear engagement with top edge portions of said base end and base side walls respectively when said wall members are in the vertical errected position;

and hinge means acting between said end and side wall members and said base end and base side walls respectively, lip means on the bottom edge portions of said end and side wall members, shoulder means on the top edge portions of said base end and base side walls, said lip means being in force bearing engagement with said shoulder means when the container wall members are in the vertical erected position, whereby loading forces applied to the inner surfaces of said container wall members are totally absorbed by said side and end edge flanges and said lip and shoulder means so as to release said hinge means from lateral loading forces acting on the inner surfaces of said container wall members.

6. The container of claim 5, wherein;

said container side and end wall members and said base end and base side walls include substantially planar inner surfaces, said hinge means being so disposed that the planar inner surfaces of said end and side wall members are substantially coplanar with the inner surfaces of said base end and base side walls when the container wall members are in the vertical erected position.

7. The container of claim 6 wherein;

said base end walls are equal in height and said base side walls are equal in height, the elevation of said base side walls being greater than said base end walls, said side walls members being no greater in height than one half the width of the container bottom, whereby said container end wall members are foldable inwardly in an overlapping configuration and said container side wall members are foldable inwardly into abutting relation, the flanges of said side wall members being in force bearing contact with said base end walls when in the folded position.

8. The container of claim 6 wherein; one of said opposed base end walls is greater in elevation than the other of said base end walls the approximate thickness of the wall members, whereby said container end wall members are foldable inwardly in overlapping parallel configuration on said bottom wall, said base side walls being greater in elevation than said base end walls with one of said opposed base side walls being greater in elevation than the other the approximate thickness of the wall members, whereby said container side wall members are foldable inwardly in overlapping parallel configuration on said folded end wall members, and load supporting post means extending upwardly from said base side walls above the level of the folded side wall members to permit stacking on the collapsed container.

9. The container of claims 5 wherein said hinge means comprises;

a hinge body extending downwardly from the bottom edge portion of a container wall member and being molded integrally therewith, and a mating recess with sides and a bottom formed in the associated base wall, said recess including coaxial hinge bosses integral with the sides of the recess, boss receiving means on said hinge body adapted to provide a pivotal axis for said container walls, shoulder means molded integrally with and extending upwardly from the bottom of said recess, and a protrusion on the bottom of said hinge body adapted to contact said shoulder means to limit pivoting of the container wall member in the outward direction from a vertical position, said pivotal axis being located such that the inner surface of the container wall member is substantially coplanar with the inner surface of the base wall when the container wall member is in the vertical position.

10. The container of claim 9 wherein said hinge body comprises;

a first relatively rigid hinge element having with a slotted opening providing a boss receiving means, and a second relatively flexible hinge element having a base therein adapted to surround and retain an adjacent hinge boss, whereby said second hinge element may be deformed to snap the hinge body into position on said hinge bosses.

11. The container of claim 10 including;

an abutment member molded integrally with a base wall, and stop means molded integrally with a container wall member and adapted to engage said abutment member when the container wall member is in the vertical position, said abutment member and said stop means being so disposed as to transfer lateral shock loads against the outside of the container wall member directly to the base wall without damage to said hinge means.

12. A container comprising in combination; base means providing a container floor, an opposing pair of side and an opposing pair of end walls, hinge means pivotally connecting said side and end walls to said base means with the side and end walls being pivotal between an upright position and a collapsed folded position disposed over said floor, mating engagement means on the respective adjacent pairs of side edges of said side and end walls for preventing said walls when in their upright position from pivoting outwardly beyond the vertical when engaged, said mating engagement means including for an adjacent pair of said edges presented by a pair of adjacent side and end walls a flange extending along the side edge of the end wall projecting away from the inner face of the end wall and a flange extending along the side edge of the side wall projecting inwardly from the edge of the side wall and in parallel spaced relation to the inner face of the side wall, said flanges interfitting to become engaged with the side and end walls moving from their collapsed to their upright position, and means on said mating engagement means preventing relative longitudinal movement of the respective edges having said flanges when the flanges are engaged.

13. The container of claim 12 including latch means operatively associated with said mating engagement means to prevent inward collapsing of said walls prior to filling of the container, said latch means comprising a slide member movable to a position preventing disengagement of said flanges.

14. The container of claim 12 wherein said floor comprises an upwardly curved convex surface means for receiving loads within said container, said convex surface means serving to transfer vertical loads thereon into said base means and said walls.

15. The container of claim 12, wherein; said hinge means comprises for each wall a hinge body extending downwardly from the bottom edge of the wall and molded integrally with the wall, and a mating recess with sides formed in the base means into which the hinge body extends, said recess including at least one boss extending outwardly from a side of the recess molded integrally with the base means and said hinged body having a slot receiving said boss with the lateral insertion of the boss; and wherein the bottom edges of said walls are disposed for force bearing rectilinear engagement with said base means when said walls are in their upright position, whereby loading forces applied to the inner surfaces of said container walls are absorbed by said rectilinear engagement so as to release said hinge means from lateral loading forces acting on the inside surfaces of said container walls.

16. A container comprising:

molded plastic base means including a rectangular floor forming the bottom of the container, a pair of oppositely facing upstanding subwalls extending upwardly from said floor at ends of the floor and a pair of oppositely facing upstanding subwalls extending upwardly from said floor at the sides of the floor, a first pair of molded plastic opposed wall members and hinge means pivotally attaching the wall members to respective ones of one of said pair of subwalls for pivotal movement about a horizontal axis and a second pair of molded plastic opposed wall members and hinge means pivotally attaching said second pair of wall members to respective ones of the other of said pair of subwalls for pivotal movement about a horizontal axis, said first and second pair of wall members being pivotally moveable from an upstanding position toward each other to a collapsed position disposed over the floor of the container, each of the subwalls along the upper edge thereof including a groove extending along the inner side of the subwall and a shoulder extending beside the groove and each wall member including along the lower edge thereof a bottom expanse which comes to rest on the shoulder with the wall member upright and a lip which seats within the groove with the wall member upright, adjacent edges of adjacent wall members with the wall members upright further having oppositely facing flanges which fit beside each other and engage with the wall members upright to prevent the wall members from pivoting outwardly beyond the their upright position, said hinge means including a hinge body extending downwardly from the bottom edge of a wall member molded integral with the wall member and a mating recess with sides formed in the subwall to which the wall member is attached, the recess having at least one boss projecting from a side thereof molded integral with the subwall, the hinge body extending into the recess, said hinge body and boss being configured to produce a disconnectable interfitted relationship producing hinging movement of the wall member with respect to its subwall.

* * * * *